United States Patent [19]

Gallagher

[11] 4,072,140

[45] Feb. 7, 1978

[54] FIREPLACE HEAT LOSS SHIELD

[76] Inventor: John F. Gallagher, 4109 Hiawatha Drive, Madison, Wis. 54303

[21] Appl. No.: 749,359

[22] Filed: Dec. 10, 1976

[51] Int. Cl.[2] ..... F24C 15/10

[52] U.S. Cl. ..... 126/140; 126/202; D7/208; 160/351; 160/DIG. 9

[58] Field of Search ..... 126/138, 140, 202; D7/208; 160/351, DIG. 9

[56] References Cited

U.S. PATENT DOCUMENTS

| | | | |
|---|---|---|---|
| 1,605,200 | 11/1926 | Bacon | 160/DIG. 4 |
| 2,432,047 | 12/1947 | Sterick et al. | 160/351 |
| 2,491,707 | 12/1949 | Boyden | D7/208 |
| 3,375,818 | 4/1968 | Luther | 126/135 |
| 3,830,219 | 8/1974 | Gibbs | 126/202 |

FOREIGN PATENT DOCUMENTS

| | | | |
|---|---|---|---|
| 624,892 | 6/1949 | United Kingdom | 126/138 |

*Primary Examiner*—Ronald C. Capossela

*Attorney, Agent, or Firm*—Harry C. Engstrom; Theodore J. Long

[57] ABSTRACT

A fireplace heat loss shield having a fabric cover of woven fire resistant material that is emplaceable over the fireplace opening to inhibit loss of heated room air. The cover has pockets sewn along all four edges thereof, into which a rigid, rectangular frame is emplaced. The frame maintains the rectangular shape of the cover, and supports the cover in an upright position over the fireplace opening by horizontally extending legs which are rigidly attached to the supporting portion of the frame, and which extend horizontally outward from openings at the bottom corners of the cover. Draft up the chimney of the fireplace maintains the cover firmly against the edges of the fireplace opening, and air vent openings may be provided in the cover to allow some ventilation of smoldering material in the fireplace area and to relieve the inward suction on the fireplace cover.

6 Claims, 2 Drawing Figures

FIREPLACE HEAT LOSS SHIELD

BACKGROUND OF THE INVENTION

1. Field of the Invention

This invention pertains generally to devices for closing off the opening of the fireplace to inhibit the drawing of air therein.

2. Description of the Prior Art

It is well known that the updraft resulting from hot gases arising from a fire in a fireplace will draw out large amounts of heated air out of a room and discharge this heated air through the chimney. Glass doors are commonly utilized to close off the fireplace opening where an external source of outside air can be introduced into the fireplace to maintain combustion. Such glass doors allow radiated heat to enter the room, but prevent room air from entering the fireplace. Glass doors may be utilized in fireplaces not having an outside source of ventilation air, but in such a case a closeable ventilator must be provided in the glass door enclosure to allow some room air to be drawn into the fireplace to maintain combustion.

Where the use of the above described fireplace doors is not possible, or is not desired for aesthetic reasons, substantial amounts of room heat can be lost through the fireplace. During active combustion of the fire in the fireplace, this room air loss is generally compensated for by the heat conducted and radiated from the fire itself, and it would obviously not be desirable to close off the fireplace opening during the time the material is burning in the fireplace. After the material in the fireplace has completely died down, the damper on the fireplace chimney may be closed to prevent loss of room heat through the chimney. However, during the period of time that the fire has substantially died down but is continuing to smolder, the damper cannot be closed without introducing smoke into the room, and it is during this period of time that substantial amounts of room heat are lost through the fireplace without any compensating gain of heat from combustion in the fireplace. Moreover, in older fireplaces the damper system often does not provide an adequate seal, and a considerable amount of warm room air is able to rise through the fireplace.

To prevent the loss of heated air through the fireplace when active combustion is not taking place therein, various closure devices have been proposed to temporarily seal off the opening of the fireplace. Various of these devices employ a window shade type device mounted above the fireplace opening, in which a fire resistant fabric is pulled down in the manner of a window shade to cover the fireplace opening. An example of this type of device is shown in the U.S. patent to Luther, U.S. Pat. No. 3,375,818. Such devices require a permanent mounting above the fireplace, and thus detract from the appearance of the fireplace, and they do not adequately close off the sides of the fireplace opening as air is sucked into the fireplace opening by the updraft from burning embers.

SUMMARY OF THE INVENTION

The fireplace shield of my invention provides a portable shield which can be temporarily used to close off the fireplace opening and provide a substantially air-tight seal thereon to prevent the loss of heated room air by convection up the fireplace chimney. My fireplace shield is light, and portable, and can be utilized to seal off the fireplace while relatively hot burning embers remain in the fireplace. The fireplace shield folds up to a compact rectangular form which may be easily stored when not in use.

My fireplace shield includes a generally rectangular cover composed of a fireproof woven fabric material, and is sized to be somewhat larger than the fireplace opening. The material of which the fireplace cover is composed is not only fire resistant, but desirably is capable of withstanding constant application of relatively high heat in the range of 300° F. for long periods of time without melting or weakening structurally. The use of such material allows my fireplace shield to be utilized even with a small fire burning in the fireplace, and in the presence of the sometimes considerable heat provided by smoldering embers. The cover has pockets formed along the four edges thereof, preferably by folding over the edge material and sewing the same back to the cover material to form the pockets. All of the pockets along the edges of the cover are enclosed except for two openings at the bottom corners of the cover.

A rigid, generally rectangular frame fits within and engages the pockets of the cover at the edges thereof to provide rigidity and vertical support to the flexible fabric cover. The frame also includes support legs extending horizontally out from the openings at the bottom corners of the cover, which are rigidly connected to the supporting frame and which provide lateral support for the frame and for the cover that is carried thereby. The supporting legs are preferably horizontally rotatable, to allow them to be folded up onto the cover to form a compact rectangular unit which can be easily stored in a closet, or which may be emplaced in a carrying box to prevent any soot accumulating on the cover from coming in contact with other house furnishings.

Vent openings may be provided in the cover to allow limited amounts of room air to be allowed therethrough to ventilate the fire in the fireplace and to relieve some of the inward draft pressure on the fireplace cover as it closes off the fireplace. These openings are preferably protected by grommets to prevent tearing of the fabric, and are preferably relatively small in size to allow only a very limited amount of air to pass into the fireplace area. The cover itself is preferably substantially air-tight, allowing very little ventilation air to pass through the tight weave of the fabric. The fabric may be treated to further reduce the amount of air that may be drawn therethrough.

Further objects, features, and advantages of my invention will be apparent from the following detailed description taken in conjunction with the accompanying drawings showing a preferred embodiment of a fireplace heat loss shied exemplifying the principles of my invention.

DESCRIPTION OF THE PREFERRED EMBODIMENT

Figure 1:
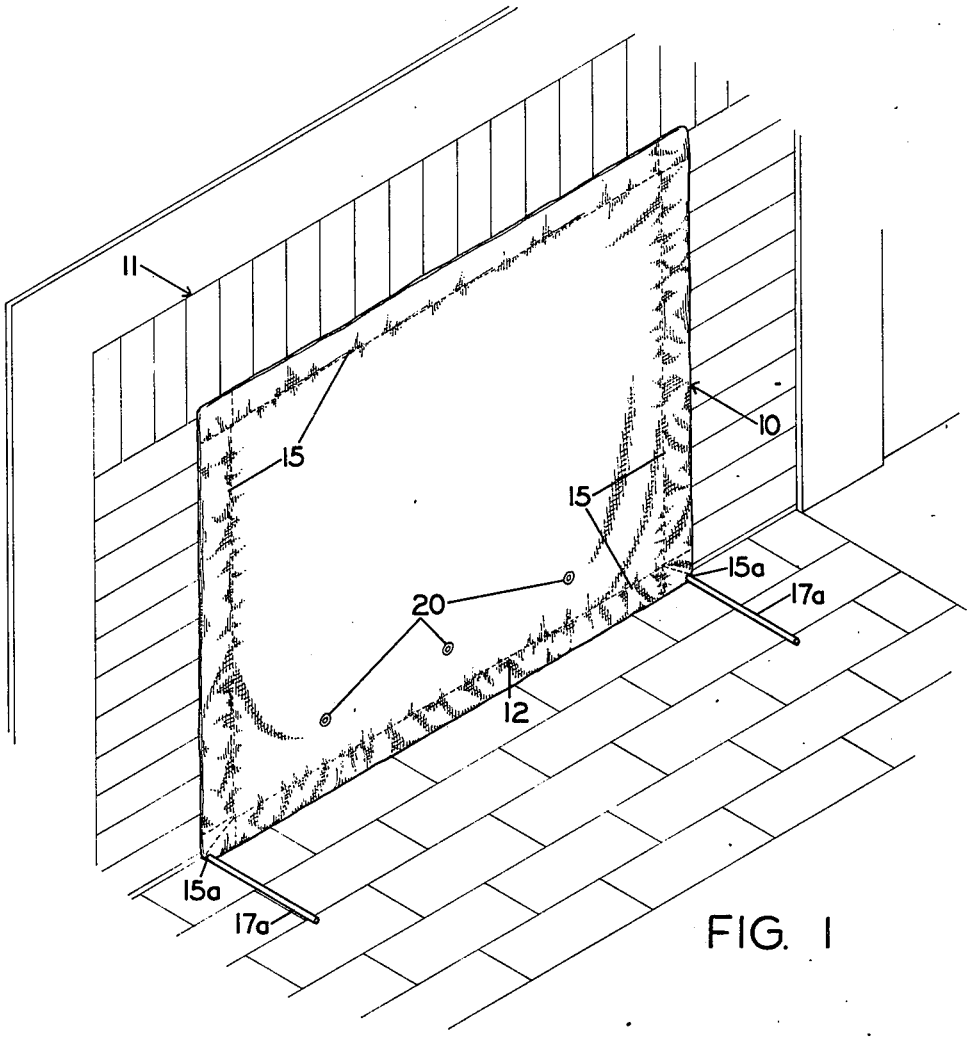
FIG. 1 is an isometric view of my fireplace heat loss shield shown in place at the opening of a fireplace shown for purposes of illustration.

Referring now more particularly to the drawings, wherein like numerals refer to like parts in both views, a preferred embodiment of my fireplace heat loss shield is shown generally at 10 in FIG. 1, in place on a standard masonry fireplace shown illustratively at 11 in FIG. 1. The fireplace shield 10 may be used generally with any fireplace having a square or rectangular front opening, and it will be apparent that the size of my fireplace shield may be selected to accommodate the size of the opening in the fireplace.

The fireplace shield 10 has a generally rectangular fireplace opening cover 12 which is selected in size to be somewhat larger in both horizontal and vertical dimensions than the opening of the fireplace. The cover 12 is formed of a fire resistant woven fabric material that is capable of withstanding the heat provided by smoldering embers or a small fire within the fireplace. Because the fireplace cover is larger than the opening of the fireplace, when it is emplaced up against the fireplace opening, as is shown in FIG. 1, the drafting of air into the fireplace will draw the flexible cover firmly against the edges of the fireplace opening to provide a substantially air-tight seal over the opening. Some drafting may be allowed through the interstices of the woven fabric, but this passage of air may be minimized by utilizing a tightly woven fabric and coating the fabric to block the openings therein. An example of a material that I have found suitable for forming the cover 12 is a silicon coated fiberglas woven fabric available from Cooley Inc. of Pawtucket, R.I. This material is not only fire resistant, but is capable of withstanding constant applications of high temperatures in the range of 300° F. or higher for long periods of time without melting or weakening structurally. Such material is preferred over meltable fire resistant material, since it allows the use of my heat shield even during the smoldering or slight blazing of a fire within the fireplace, and will also allow my fireplace shield to be used as an effective damper to shut off the source of air to a blazing fire within the fireplace when it is desired to immediately quench the fire.

A rigid frame 14 (not shown in FIG. 1) engages and supports the cover 12 at the edges thereof to stretch it and maintain it in its generally rectangular shape. The frame 14 is emplaced at the outside edges of the cover, such that when the fireplace shield 10 is placed up against the opening of a fireplace as shown in FIG. 1, the rigid edges of the frame will abut against the outside surfaces of the fireplace, and the inward draft produced by the rising air within the fireplace will draw the flexible fabric cover 12 inwardly to substantially seal the cover 12 around the edges of the fireplace opening. While a perfect air-tight seal is not attainable, it is seen that a more effective air impeding seal is provided by the flexible fabric of the cover 12 sealing against the edges of the fireplace than would be provided by a rigid solid fireplace shield such as one made of metal.

Figure 2:
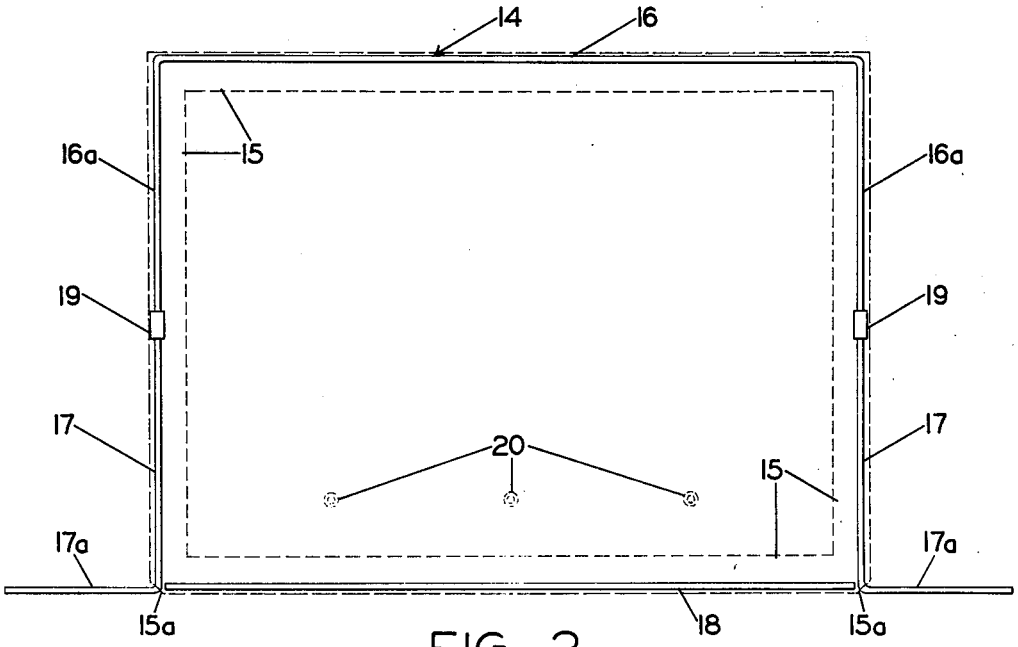
FIG. 2 is a front elevational view of the heat loss shield of FIG. 1, showing the rigid frame of the shield, with the position of the flexible fabric cover shown in dashed lines for illustration.

The cover 12 has pockets 15 formed therein along the four sides of the cover. These pockets are preferably formed by overlapping the edges of the cover back onto the body of the cover and stitching the overlapped portions down. The pockets 15 are shown in dashed lines for purposes of illustration in FIG. 2, which best shows the construction of the frame 14. As shown therein, the frame is inserted within these pockets and is held therein to give structural rigidity to the cover and to provide vertical support thereto. The frame 14 is preferably composed of an upper U-shaped rod portion 16, and a pair of L-shaped brackets 17 which have generally horizontal leg portions **17*a* which extend horizontally outward from openings 15*a* in the pockets at the bottom corners of the cover. A straight rigid rod 18 may be inserted into the bottom pocket to provide rigid support to the bottom of the cover. The vertical portions of the bracket 17 are rotationally connected by rotational couplings 19 to the side portions 16*a* of the U-shaped upper rod 16. The rotational coupling of the bracket 17 to the upper member 16 allows the horizontal legs 17*a* to rotate in a generally horizontal plane. This rotation of the legs 17*a* allows them to be rotated to a position in which they are substantially perpendicular to the plane of the cover as shown in FIG. 1, to thereby provide maximum lateral support to the fireplace shield when it is placed up against a fireplace opening. When the fireplace shield is not in use, the legs 17*a*** may be rotated inwardly toward the cover to allow the fireplace shield to form a compact unit which may be easily stored, for example, in a rectangular box which allows the storage of the cover without the possibility of accidentally dislodging soot from the cover onto home furnishings.

Vent openings 20 may be provided in the cover 12 to allow some ventilation of the material within the fireplace itself and to relieve somewhat the suction on the fireplace shield as draft is drawn up the chimney. As shown in FIG. 1, these vent openings preferably consist of small holes near the bottom of the cover which have reinforcement such as metal grommets in place thereon to prevent tearing of the fabric of the cover. Some slight ventilation of the fire may be desirable to allow minimal combustion of the material within the fireplace without excess smoke, while preventing substantial introduction of heated air through the openings into the fireplace. Thus, the openings 20 are preferably made quite small, in the range of ½ inch or less, to limit the amount of air that may be drawn into the fireplace.

It is understood that my invention is not confined to the particular construction and arrangement of parts herein illustrated and described, but embraces all such modified forms thereof as come within the scope of the following claims.

I claim:

1. A fireplace heat loss shield for closing off the opening of the fireplace to prevent substantial introduction of air therein, comprising:

a. a substantially rectangular fireplace opening cover, said cover being formed of a fire resistant flexible woven fabric material which will substantially inhibit the passage of air therethrough; and b. a rigid frame adapted to engage said cover at the edges thereof to maintain said cover in its generally rectangular shape and to provide vertical support thereto, said cover being unsupported within said frame at the edges of said cover, said frame including legs extending out horizontally from the bottom of said cover which are adapted to provide lateral support to said frame and cover when the heat loss shield is placed against the opening of a fireplace such that the drafting of air into the fireplace will draw said flexible cover firmly against the edges of the fireplace opening to thereby provide a substantially air tight seal over the opening.

2. The fireplace heat loss shield of claim 1 including means for rotatably coupling said legs to said frame for rotation in a horizontal plane to thereby allow said legs to be folded in toward said cover for storage of the heat loss shield.

3. The fireplace heat loss shield of claim 1 wherein said cover is formed of silicon coated woven fiberglas.

4. The fireplace heat loss shield of claim 1 wherein said cover has at least one opening therein to allow limited amounts of ventilation air to pass therethrough into the fireplace area.

5. A fireplace heat loss shield for closing off the opening of the fireplace to prevent substantial introduction of air therein, comprising:

a. a substantially rectangular fireplace opening cover, said cover being formed of a fire resistant flexible woven fabric material which will substantially inhibit the passage of air therethrough; and b. a rigid frame adapted to engage said cover at the edges thereof to maintain said cover in its generally rectangular shape and to provide vertical support thereto, said frame including a U-shaped upper rod member, a pair of L-shaped bracket members rotatably coupled to the ends of said U-shaped upper rod member, said bracket members including leg members extending horizontally outward from bottom corner openings in said cover, said leg members providing lateral support to said frame and cover when the heat loss shield is placed against the opening of a fireplace, and a bottom straight rigid rod which is emplaced along the bottom edge of said cover.

6. A fireplace heat loss shield for closing off the opening of the fireplace to prevent substantial introduction of air therein, comprising:

a. a substantially rectangular fireplace opening cover, said cover being formed of a fire resistant flexible woven fabric material which will substantially inhibit the passage of air therethrough and which will not melt at temperatures below approximately 300° F., said cover having pockets formed therein along the edges thereof with the pockets being open at the two bottom corners of said cover; and b. a rigid frame adapted to engage said cover at the edges thereof and to set within the pockets of said cover to maintain said cover in its generally rectangular shape and to provide vertical support thereto, said frame including a pair of legs extending out horizontally from the openings at the bottom corners of said cover to provide lateral support to said frame and cover when the heat loss shield is placed against the opening of a fireplace.

* * * * *